United States Patent [19]

Sines et al.

[11] Patent Number: 4,490,186

[45] Date of Patent: Dec. 25, 1984

[54] THERMAL-MECHANICAL WORKING OF WROUGHT NON-HARDENABLE NICKEL ALLOY

[75] Inventors: Roger B. Sines, Manchester; Thomas T. Field, Killingly; Patrick F. Papineau, Marlborough, all of Conn.

[73] Assignee: United Technologies Corporation, Hartford, Conn.

[21] Appl. No.: 440,674

[22] Filed: Nov. 10, 1982

[51] Int. Cl.[3] ..... C22D 1/10

[52] U.S. Cl. ..... 148/11.5 N; 148/11.5 Q; 148/127; 148/427; 228/158

[58] Field of Search ..... 148/11.5 N, 11.5 Q, 148/127, 427; 420/454; 228/158

[56] References Cited

U.S. PATENT DOCUMENTS 3,279,050 10/1966 Simich ..... 228/158

3,645,726 2/1972 Copson et al. ..... 148/11.5 N

*Primary Examiner*—L. Dewayne Rutledge

*Assistant Examiner*—Robert L. McDowell

*Attorney, Agent, or Firm*—C. G. Nessler

[57] ABSTRACT

The weld zone in Hastelloy X nickel superalloy is thermal mechanically worked by cold working the weld zone to reduce its thickness by about 5–40%, and by annealing at 1120°–1175° C. for one hour to cause recrystallization. Low cycle fatigue properties of laser and gas tungsten arc weld zones are substantially increased.

3 Claims, 4 Drawing Figures

THERMAL-MECHANICAL WORKING OF WROUGHT NON-HARDENABLE NICKEL ALLOY

DESCRIPTION

Background

1. The present invention relates to thermal-mechanical processing of welded wrought nickel alloys.

2. A related application, Ser. No. 440,673 "Contour Forming Conical Shapes" filed on even date herewith by Sanborn et al discloses how conical segments of combustor liners may be formed from the alloy Hastelloy X, for use in gas turbine engines. Part of the disclosed procedure involves making a longitudinal butt weld which runs circumferentially in the finished segment. Being so positioned, the weld is subject to particularly high stress when the segment is used in a gas turbine engine. As is well known, the properties of a cast weld zone will be different from those in the remainder of the wrought structure.

Gas turbine engine combustor liners are particularly susceptible to low cycle fatigue failures. Hastelloy X, a nickel-base alloy, has been used in the construction of combustor liners for many years. The properties of welded Hastelloy X and the processing necessary to produce optimum properties are well characterized. However, it is also known that welded Hastelloy X, even after the post weld heat treatments, has weld zone properties which are substantially inferior to wrought Hastelloy X. For this reason, the design and construction of combustor liners heretofore has taken this inferiority into account.

While there has been a well recognized desire to raise weld properties, the configuration of the combustor liners has not permitted more than the normal annealing heat treatments. Sheet metal burners, nominally 1.3 mm thick, are susceptible to excessive distortion when the assembly is heat treated at a temperature greater than 1100° C.

Now, an improved combustor liner design has been invented, as described in the patent application Ser. No. 227,317 "Combustor Liner Cooling Scheme" filed Jan. 22, 1981 by Dierberger; a novel way of constructing the combustor liner is disclosed in the aforementioned application of Sanborn et al. (The disclosures of both the foregoing applications are hereby incorporated by reference.) The new design and method of fabrication disclosed in the other applications provide the need and opportunity for improving the properties of welded Hastelloy X.

DISCLOSURE OF THE INVENTION

An object of the invention is to provide in a welded nickel base alloy, such as Hastelloy X, properties in the weld zone which are equivalent to the properties of the wrought material. A further object is to thermal mechanically process welded Hastelloy X, to improve its low cycle fatigue properties.

According to the invention, a weldment made of wrought Hastelloy X is cold worked after welding so that the weld zone is reduced in cross sectional area by at least 5%, preferably 20%. The weld zone is then subjected to annealing at 1120°-1175° C. for one hour. In the invention there is an interrelation between reduction in area and the annealing temperature. Excess reduction in area or excess annealing temperature can result in excessive grain growth which is associated with low fatigue life. On the other hand, a combination of low reduction in area and low annealing temperature will produce poor metallurgical structure and poor fatigue life.

For typical strain range conditions, the invention provides fatigue properties in the weld zone which are equivalent to unwelded Hastelloy X sheet. Fatigue life will be increased three times over that which results in the absence of the invention.

The foregoing and other objects, features and advantages of the present invention will become more apparent from the following description of preferred embodiments and accompanying drawings.

BEST MODE FOR CARRYING OUT THE INVENTION

The invention is described in terms of the welding of the alloy Hastelloy X (by weight percent 20.5-23 Cr, 0.5-2.5 Co, 17-20 Fe, 8-10 Mo, 0.2-1.0 W, 0.05-0.15 C, 0-0.01 B, 0-1.0 Mn, 0-1.0 Si, 0-0.04 P, 0-0.030 S, balance Ni) which is a wrought product commonly available in sheet and mill forms under Aerospace Material Specification (AMS) 5536, AMS 5754 and Specification PWA 1038 of Pratt & Whitney Aircraft, East Hartford, Conn. Nominally, the alloy consists of 22 Cr, 1.5 Co, 18 Fe, 9 Mo, 0.6 W, 0.1 C, balance Ni. And in the present invention the Hastelloy X sheet stock is made to the aforementioned PWA 1038 specification which means it is the same as AMS 5536 except that the average grain size is finer, of the order of ASTM 8 compared to ASTM 4 for typical AMS 5536. Specifically, the invention is addressed to the forming of a weldment from butt welded pieces of material, in accord with the aforementioned Sanborn et al application.

Various means may be used to make a linear butt weld including gas tungsten arc (GTA) and laser welding (LW). Subsequent to welding, all workpieces are stress relieved by heating to 1150° C. for 8 to 15 minutes. Next the workpiece is cold rolled so that the cross sectional area of the weld zone is reduced by about 20%. By cold rolling is meant rolling at a temperature of less than 650° C., typically ambient temperature.

Subsequent to the cold reduction step, the weldment is subjected to an annealing heat treatment for one hour. The purpose of this heat treatment in the 1120°-1175° C. range is to produce recrystallization in the weld. However, significant grain growth must be avoided for the reasons set forth below. When properly performed, the annealing will result in a fully recrystallized weld zone having an average ASTM E-112 grain size range of ASTM No. 4-8 (0.0898 to 0.0224 mm in nominal diameter).

Figure 1:
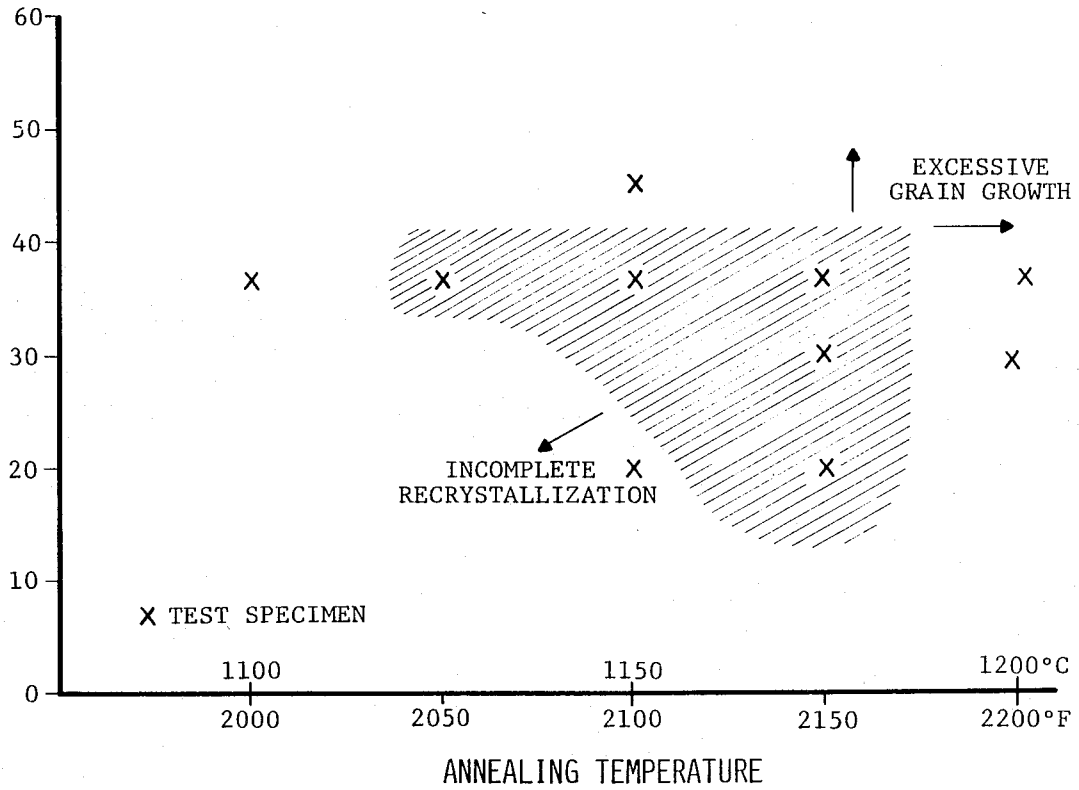
FIG. 1 is a graph showing the interrelated effects of cold work and subsequent annealing temperature on the grain size of Hastelloy X alloy.

FIG. 1 shows the relationship between the reduction in cross sectional area of the weld zone and the annealing temperature insofar as recrystallization and grain growth are concerned. Generally, annealing temperatures less than about 1100° C. are insufficient to cause recrystallization and those greater than about 1200° C. produce excessive grain growth. From FIG. 1 it is seen that when the reduction in area is low, then relatively higher annealing temperatures are needed to obtain recrystallization. On the other hand, if the reduction in area is too great, then there may be somewhat more tendency for excessive grain growth (although it is well recognized temperature is the most influential variable).

Figure 2:
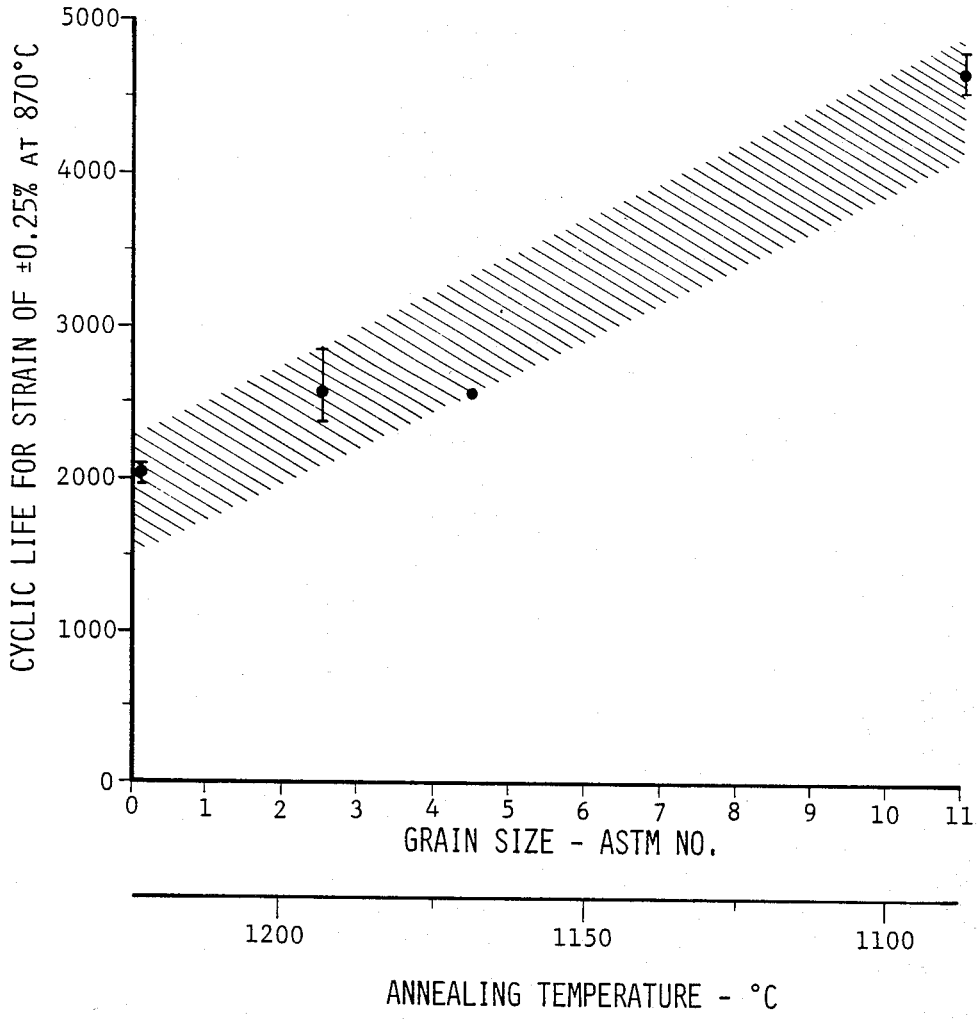
FIG. 2 is a graph showing the effect of grain size on low cycle fatigue life of Hastelloy X rolled sheet.

Excessive grain growth is associated with poor fatigue properties as our test data in FIG. 2 demonstrate. PWA 1038 material was annealed at different temperatures to produce grains ranging in size from coarse to fine. Fatigue life decreased by about a factor of two when the higher annealing temperatures caused heavy grain growth. While heavy reduction in area promotes good recrystallization dynamics, there are problems associated with it. First, cracking of the workpiece can occur upon great reduction in area unless intermediate annealing steps are employed (which are to be avoided for cost reasons). Secondly, as reference to the Sanborn et al application will show, there is a criticality in the reduction in area related to the configuration of the particular conical workpiece which is useful for combustor liners. As the Sanborn et al application indicates, the percentage reduction in area for their particular workpiece will be between 0–40%. Thus, it is a question as to what combinations of cold working and heat treatment are useable.

FIG. 2 shows how the 870° C. fatigue life is increased when grain size decreases as a result of thermal mechanical processing. (Note that in the figure, finer grain size is on the right, associated with bigger ASTM Number.)

Figure 3:
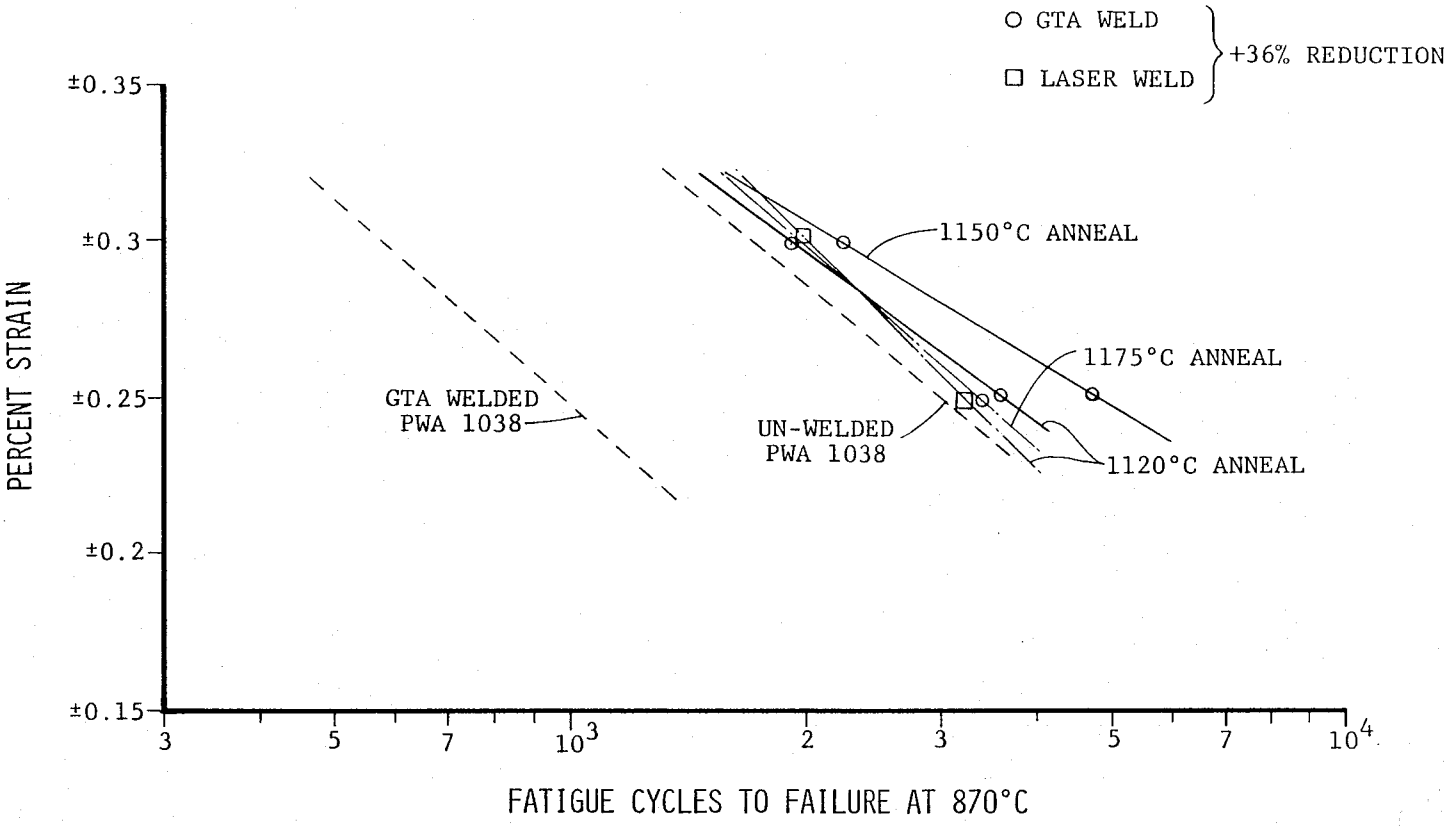
FIG. 3 is a graph showing how fatigue life varies with strain range for unwelded, welded and welded and annealed Hastelloy X alloy.

FIG. 3 shows the fatigue life for 870° C. fully reversed bending of 1.27 mm thick strip stock fatigue specimens with fully machined weld zones. It is seen that as-welded Hastelloy X has substantially inferior properties compared to the unwelded baseline material which was in the PWA 1038 as-received mill annealed condition. However, for the specimens which were cold rolled to about 36% reduction and then annealed, it is seen that the properties are substantially improved, to be equal or better than the unwelded material.

Figure 4:
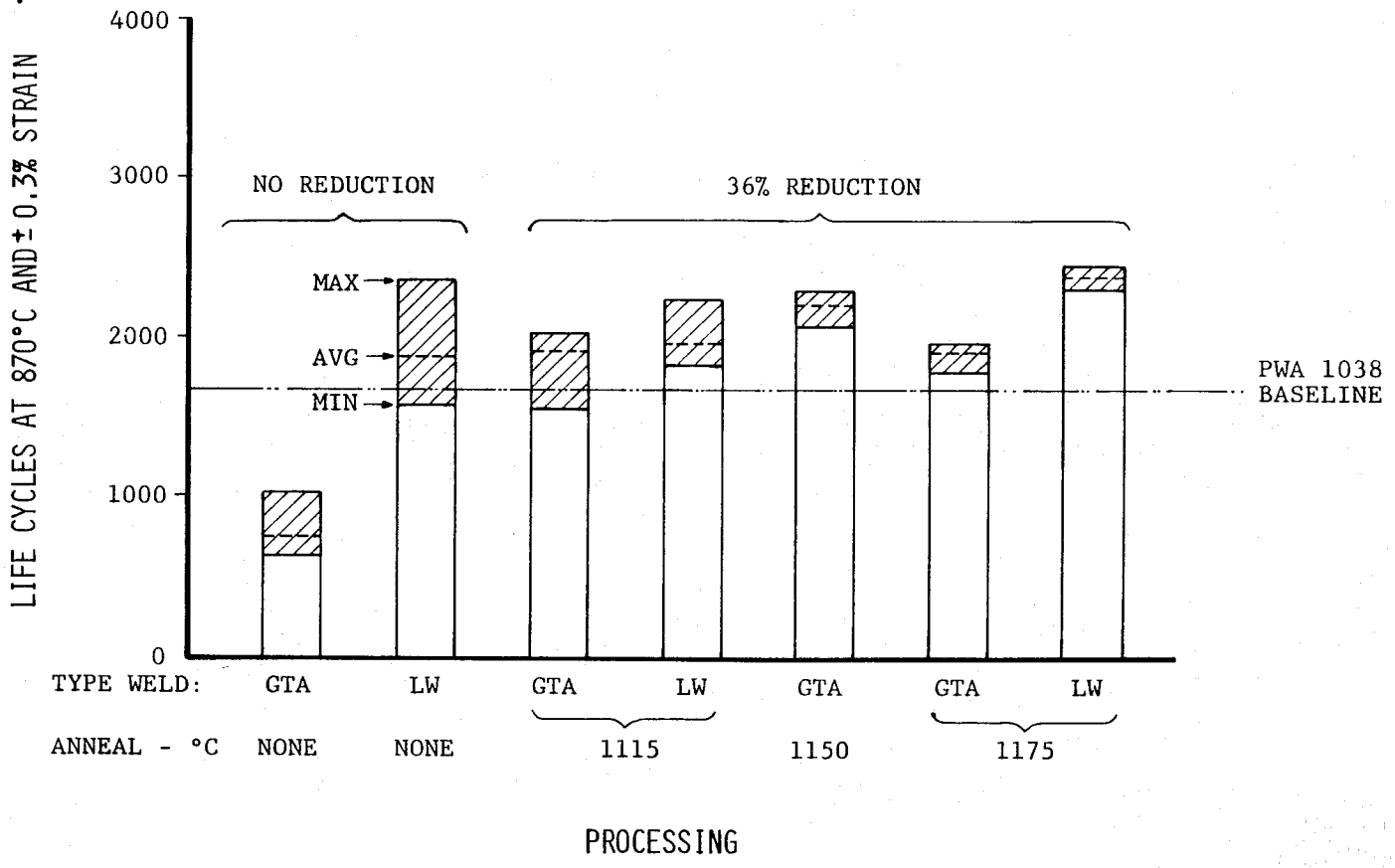
FIG. 4 is a bar chart showing how fatigue life varies with the thermal mechanical working of welded Hastelloy X alloy.

FIG. 4 provides additional data which enables a further distinction to be made based on 870° C. reversed bending fatigue testing with ±0.3% strain for at least three specimens at each condition. First, it is seen that the as-welded specimens have a first set of properties, with the GTA welded specimens being inferior to laser welded specimens. Cold reduction and annealing increases the properties of both welds and there is indication of the superiority of the laser welding procedure.

Table 1 indicates that heat treatments in the 1120°–1150° C. range are preferred because the higher 1175° C. heat treatment is starting to cause coarse grain in the base metal and GTA weld. The Table 1 1175° C. data and FIG. 4 data tend to show that laser welding is superior to GTA welding.

Accordingly, the foregoing data indicate that if cold reduction is omitted, fatigue life will be inadequate regardless of heat treatment. At least about 5–8% cold work is needed to promote recrystallization in combination with heat treatment at the higher end of the range, at about 1175° C. With heavier reduction in area, at about 40%, lesser temperatures of about 1120° C. may be used. Regardless of heavy cold reduction, temperatures less than about 1120° C. produce inadequate recrystallization. Preferably the weld is cold reduced 20–35% and the annealing temperature is 1150±15° C. Typically, the weld zone is annealed for one hour. Lesser or greater time may be used, provided the grain size is measured to ascertain that ASTM 4–8 is obtained.

The invention will be useable with fusion welding methods in addition to GTA and LW, including plasma arc welding, electron beam welding, gas metal arc welding, and so forth. In the preferred embodiment, we disclose cold rolling to reduce the cross sectional area of the weld zone.

TABLE 1

Grain Size in Thermal Mechanically Worked Hastelloy X Alloy

| Type of Weld | Cold Reduction % | One Hour Heat Treatment °C. | ASTM Grain Size Weld Zone | ASTM Grain Size Base Metal |
|---|---|---|---|---|
| GTAW | 0 | none | (a) | 8.3 |
| LW | 0 | none | (a) | 8.1 |
| GTAW | 36 | 1120 | 8.6 | 9.4 |
| LW | 36 | 1120 | 8.2 | 9.0 |
| GTAW | 36 | 1150 | 7.8 | 8.0 |
| GTAW | 36 | 1175 | 5.3 | 3.3 |
| LW | 36 | 1175 | 8.1 | 4.3 |

Grains too elongated to use an ASTM grain size number

By weld zone we mean the region in the metal where fusion has taken place as well as the adjacent heat affected zone. Practically speaking, when the cross sectional area of the weld zone is reduced, the adjacent unaffected base metal will be also reduced to varying extent. Generally, this is not undesirable. Rolling to reduce the weldment cross section is preferred in longitudinal stock, such as in the Sanborn et al invention. But other techniques for reducing cross section including forging, swaging and so forth may be used in the alternative and for other material forms.

We expect that our specific invention will be useable with alloys which have essentially the same composition as Hastelloy X, and we believe the general principles of our invention will be applicable to other nickel and cobalt base alloys.

Although this invention has been shown and described with respect to a preferred embodiment, it will be understood by those skilled in the art that various changes in form and detail thereof may be made without departing from the spirit and scope of the claimed invention.

We claim:

1. In the fabrication of a welded structure of a wrought alloy consisting essentially by weight percent of 22 Cr, 1.5 Co, 18.5 Fe, 9 Mo, 0.1 C, 0.6 W, balance Ni, the method of providing good fatigue life to a weld zone which comprises cold working the weld zone to reduce the cross section thereof by at least 5%, thereafter heat treating the weld zone at a temperature of 1125°–1175° C. to recrystallize the weld zone; and continuing the heat treatment for about one hour to produce therein a grain size of ASTM No. 4–8.

2. The method of claim 1 characterized by cold working which reduces the cross section by 20–35% and heat treating at 1150±15° C.

3. An article produced by the method of claim 1 characterized by a wrought alloy having a grain size of ASTM No. 4–8 and a weld zone having a grain size of ASTM No. 4–8, the portion containing the weld having a fatigue life about equal to a portion having no weld.

* * * * *